US005147214A

United States Patent [19]

Korsunsky et al.

[11] Patent Number: 5,147,214

[45] Date of Patent: Sep. 15, 1992

[54] ELECTRICAL TERMINAL WHICH HAS OVERSTRESS PROTECTION

[75] Inventors: Iosif Korsunsky, Harrisburg; Dimitry G. Grabbe, Middletown, both of Pa.

[73] Assignee: AMP Incorporated, Harrisburg, Pa.

[21] Appl. No.: 766,876

[22] Filed: Sep. 27, 1991

[51] Int. Cl.[5] ..... H01R 13/00

[52] U.S. Cl. ..... 439/326

[58] Field of Search ..... 439/296, 326–328, 439/629–637

[56] References Cited

U.S. PATENT DOCUMENTS

| | | | |
|---|---|---|---|
| Re. 26,692 | 10/1969 | Ruehlemann | 339/176 |
| 3,199,066 | 8/1965 | Eledge et al. | 339/176 |
| 3,631,381 | 12/1971 | Pittman | 339/176 MP |
| 3,795,888 | 3/1974 | Nardo et al. | 339/176 MP |
| 3,848,952 | 11/1974 | Tighe, Jr. | 339/91 R |
| 3,920,303 | 11/1975 | Pittman et al. | 339/176 MP |
| 4,136,917 | 1/1979 | Then et al. | 339/17 L |
| 4,185,882 | 1/1980 | Johnson | 339/176 MP |
| 4,557,548 | 12/1985 | Thrush | 339/258 P |
| 4,558,912 | 12/1985 | Coller et al. | 339/64 M |
| 4,575,172 | 3/1986 | Walse et al. | 339/75 MP |
| 4,737,120 | 4/1988 | Grabbe et al. | 439/326 |
| 4,984,996 | 1/1991 | Watanabe et al. | 439/326 |
| 5,015,196 | 5/1991 | Yamada | 439/326 |
| 5,061,200 | 10/1991 | Lee | 439/326 |
| 5,064,381 | 11/1991 | Lin | 439/326 |

FOREIGN PATENT DOCUMENTS 1129580 5/1962 Fed. Rep. of Germany .

*Primary Examiner*—Joseph H. McGlynn

*Attorney, Agent, or Firm*—Bruce J. Wolstoncroft

[57] ABSTRACT

An electrical connector for connecting a first printed circuit board to a second printed circuit board has terminal contacts which provide a reliable electrical connection. The contact terminals are positioned adjacent to a board receiving recess, and are configured to make an electrical connection with the second printed circuit board when the second printed circuit board is rotated to a second position. Overstress projections provided on the contact terminals cooperate with shoulders of the electrical connector to prevent contact terminals from being deformed as the second printed circuit board is moved relative to the contact terminals. Contact projections are positioned on the contact terminals proximate a resilient contact arm. The contact projections electrically engage the resilient contact arm when the second printed circuit board is in the second position.

11 Claims, 6 Drawing Sheets

ELECTRICAL TERMINAL WHICH HAS OVERSTRESS PROTECTION

FIELD OF THE INVENTION

The present invention relates to electrical terminals which are provided in an electrical connector. More particularly, the invention is directed to electrical terminals which have integral overstress means provided thereon to insure that the terminals will not take a permanent set as the printed circuit boards are inserted therein.

BACKGROUND OF THE INVENTION

Low insertion force electrical connectors for making electrical connections between printed circuit boards are well known in the industry. Examples of these types of connectors are disclosed in U.S. Pat. Nos. 3,795,888; 3,848,952; 3,920,303; 4,136,917; 4,185,882; 4,575,172; and 4,737,120. The connectors disclosed in these patents are of the type which have a pair of spring contacts which allow insertion of the printed circuit boards into contact areas of the connectors under reduced insertion force conditions.

Many of these prior art connectors are provided with contacts which have a steep force/deflection curve. Consequently, the spring contacts can easily take a permanent set even if the contacts are displaced only a small amount. Therefore, there is a strong likelihood that the insertion of a wide daughter board into the connector will cause the contacts to take a permanent set. The connector is thereby rendered ineffective when the wide board is replaced by a relatively narrow board.

U.S. Pat. No. 4,737,120 teaches of a contact which has a low spring rate or a shallow force/deflection curve. This allows the contacts to have a large tolerance to the thickness of the daughter board, thereby preventing the contacts from taking a permanent set as the daughter board is inserted between the contact areas of the contacts. However, even in a connector which has contacts with a low spring rate, it is conceivable that as the daughter board is brought into engagement with the contacts, the daughter board may damage the contacts, causing the contacts to take a permanent set. This problem is magnified when the daughter board is misaligned with the opening provided between the contact areas of the contacts.

It would therefore be beneficial to provide a connector which has contacts which have means to prevent overstress of the contacts, even when the daughter board is improperly inserted into the connector.

SUMMARY OF THE INVENTION

The invention is directed to contacts for use in a card edge connector. The contacts are provided with overstress members which insure that the contacts portions will not be damaged, or take a permanent set, as the daughter boards are inserted into the connectors, even if the daughter boards are improperly aligned with the contact portions of the contacts.

The contacts provide the electrical connection between a first printed circuit board and the daughter board or second printed circuit board. The contacts have a base, an engagement portion, and at least one resilient contact member. The engagement portion cooperates with contact areas of the first printed circuit board and the resilient contact member cooperates with the contact areas of the second printed circuit board.

An overstress projection is provided on the resilient contact member. The overstress projection is bent relative to the resilient contact member, such that the longitudinal axis of the overstress projection is positioned in a different plane than the longitudinal axis of the resilient contact member.

The electrical contact also has a contact projection which extends from the base. An edge of the second resilient contact member electrically engages the contact projection when the second printed circuit board is moved to the second position.

The invention is also directed to an electrical connector for connecting a first printed circuit board to a second printed circuit board, the second printed circuit board being rotatable relative to the first printed circuit board between a first and a second position. The electrical connector has a housing with a recess provided therein which extends from proximate a first end of the housing to proximate a second end of the housing, and is dimensioned to receive the second printed circuit board therein. Contact terminals are positioned adjacent to the recess, and are configured to make an electrical connection with the second printed circuit board when the second printed circuit board is in the second position in the recess.

The contact terminals have base portions for securing the contact terminals in the housing, post portions for making electrical connection with the first printed circuit board, and resilient contact portions for making electrical connection with the second printed circuit board. The resilient contact portions have overstress projections integral therewith, the longitudinal axis of each overstress projection is offset from the longitudinal axis of the respective resilient contact portion from which it extends. Shoulders are provided in contact receiving cavities of the housing and are provided proximate the overstress projections of the resilient contact portions. Whereby as the second printed circuit board is moved relative to the contact terminals, the overstress projections engage respective shoulders of the housing to prevent the resilient contact portions from being deformed.

DETAILED DESCRIPTION OF THE INVENTION

Figure 1:
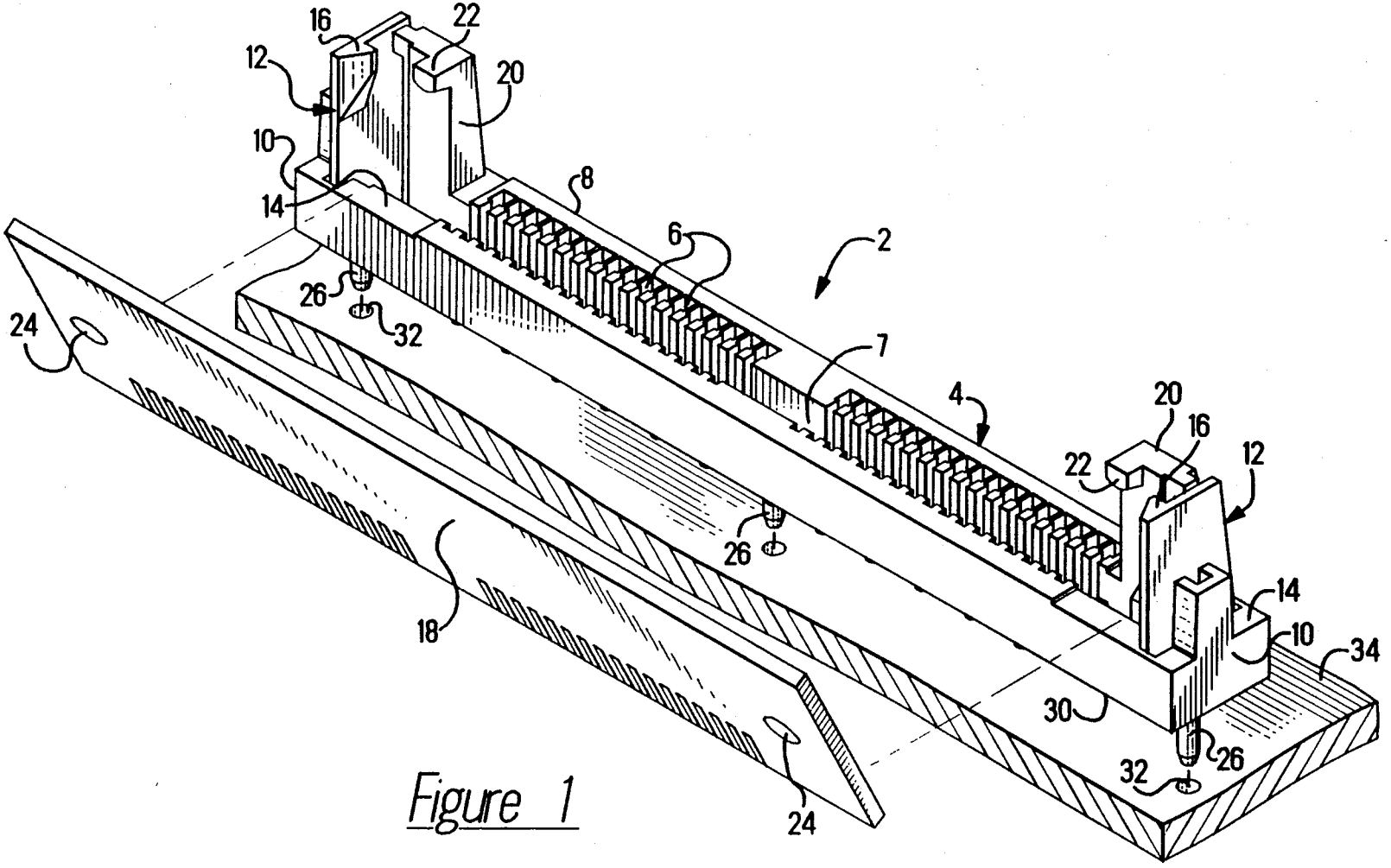
FIG. 1 is a perspective view of a connector which houses the electrical contacts of the present invention, a daughter board is shown in a preinserted position.

Referring to FIG. 1, there is illustrated a low insertion force electrical connector 2 according to the present invention. Connector 2 electrically and mechanically connects two circuit panels together as needed.

The connector is comprised of an elongated housing 4 having a plurality of contact receiving cavities 6 located in an elongated base 8. The housing 4 is made from any material having the required dielectric characteristics. A board receiving recess 7 is provided in the base and extends essentially the entire length of the base.

Proximate ends 10 of the base 8 are latch members 12 which project from a top surface 14 of the base. Each latch member 12 is essentially parallel to the ends 10 of the base 8 and has latching projections 16 positioned proximate the top of the latch member 12. The latching projections 16 of the latch members 12 face each other and cooperate with a daughter printed circuit board 18. The latch members may be integrally molded with the housing as shown, or can be made from metal and inserted into recesses in the housing, as more fully described in copending U.S. Pat. No. 4,986,765.

Adjacent latch members 12 are stop members 20 which project from the surface 14. Stop members 20 lie in a plane which is essentially perpendicular to the plane of each latch member 12. Proximate the top of the stop member 20 is an alignment projection 22 which cooperates with openings 24 in the daughter board 18 to insure that the daughter board 18 is properly positioned with respect to the connector 2.

Pegs 26 extend from a bottom surface 30 of the base proximate the ends 10 and essentially below the latch members 12. As shown in FIG. 1, pegs 26 cooperate with corresponding holes 32 of a mother board 34, thereby ensuring that the connector 2 is properly positioned on the mother board.

Figure 2:
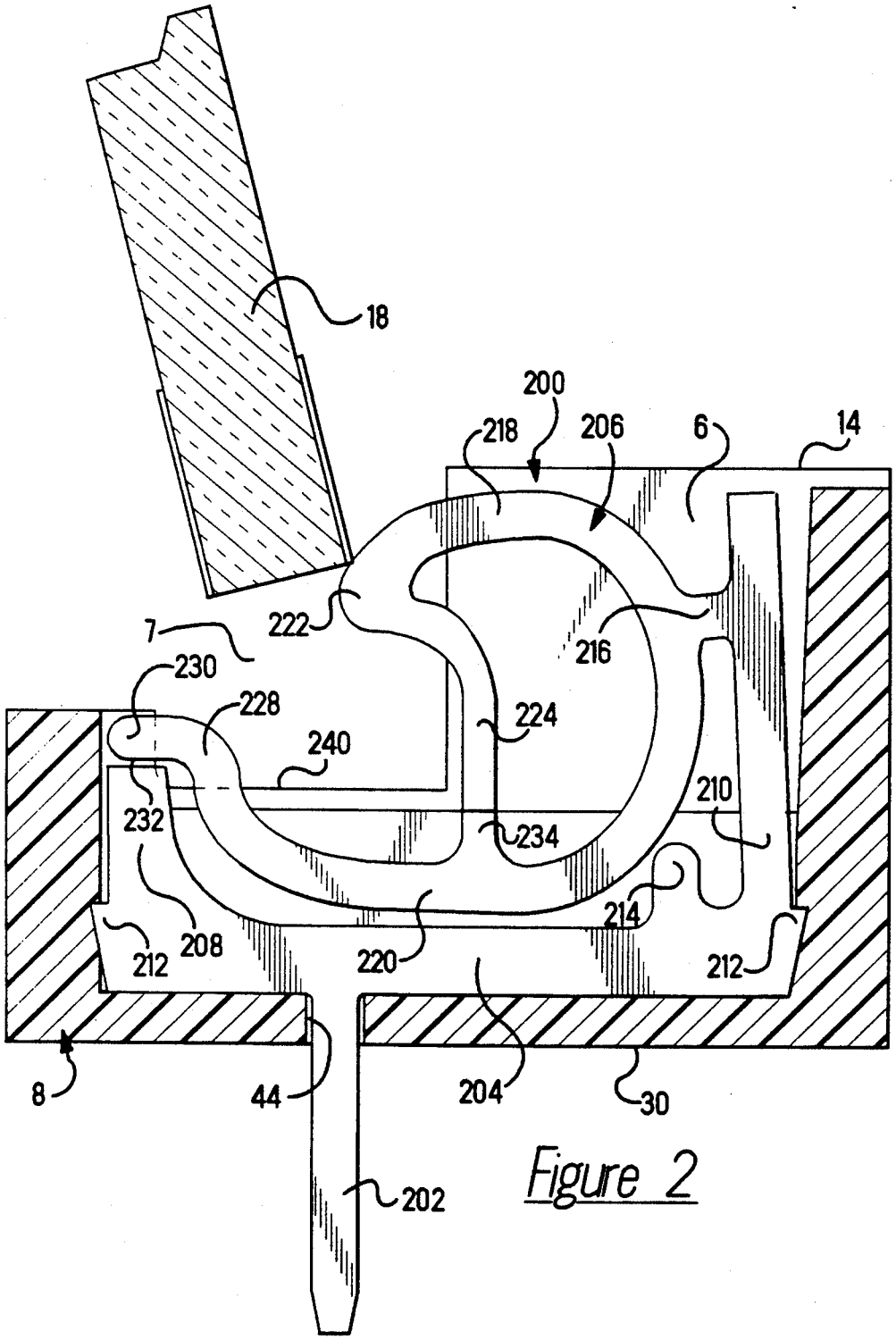
FIG. 2 is a cross-sectional view of the connector showing a daughter board as it is inserted into a contact of the connector, the daughter board is slightly misaligned from the opening of the contacts.
Figure 4:
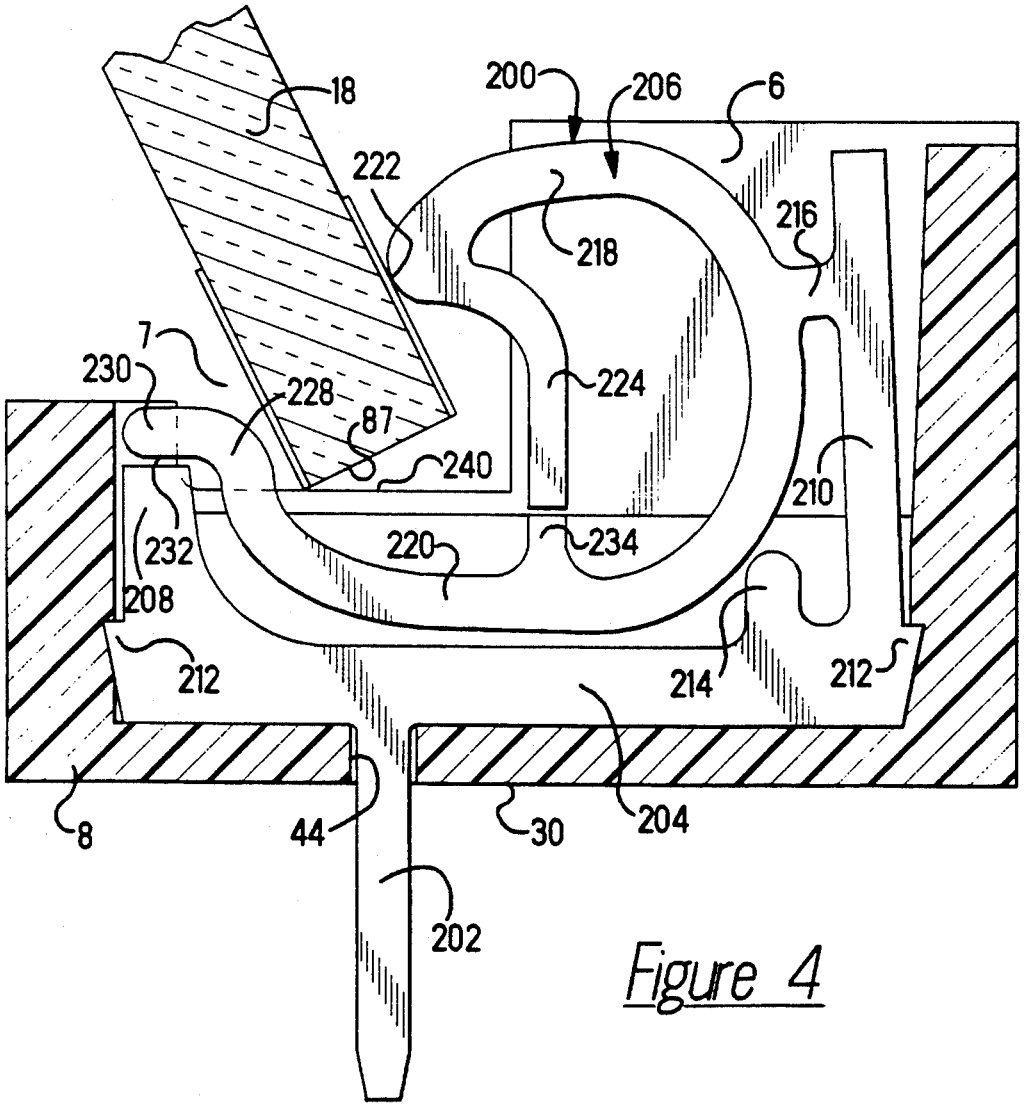
FIG. 4 is a cross-sectional view of the connector, similar to that of FIG. 2, showing the daughter board partially inserted into the connector.
Figure 6:
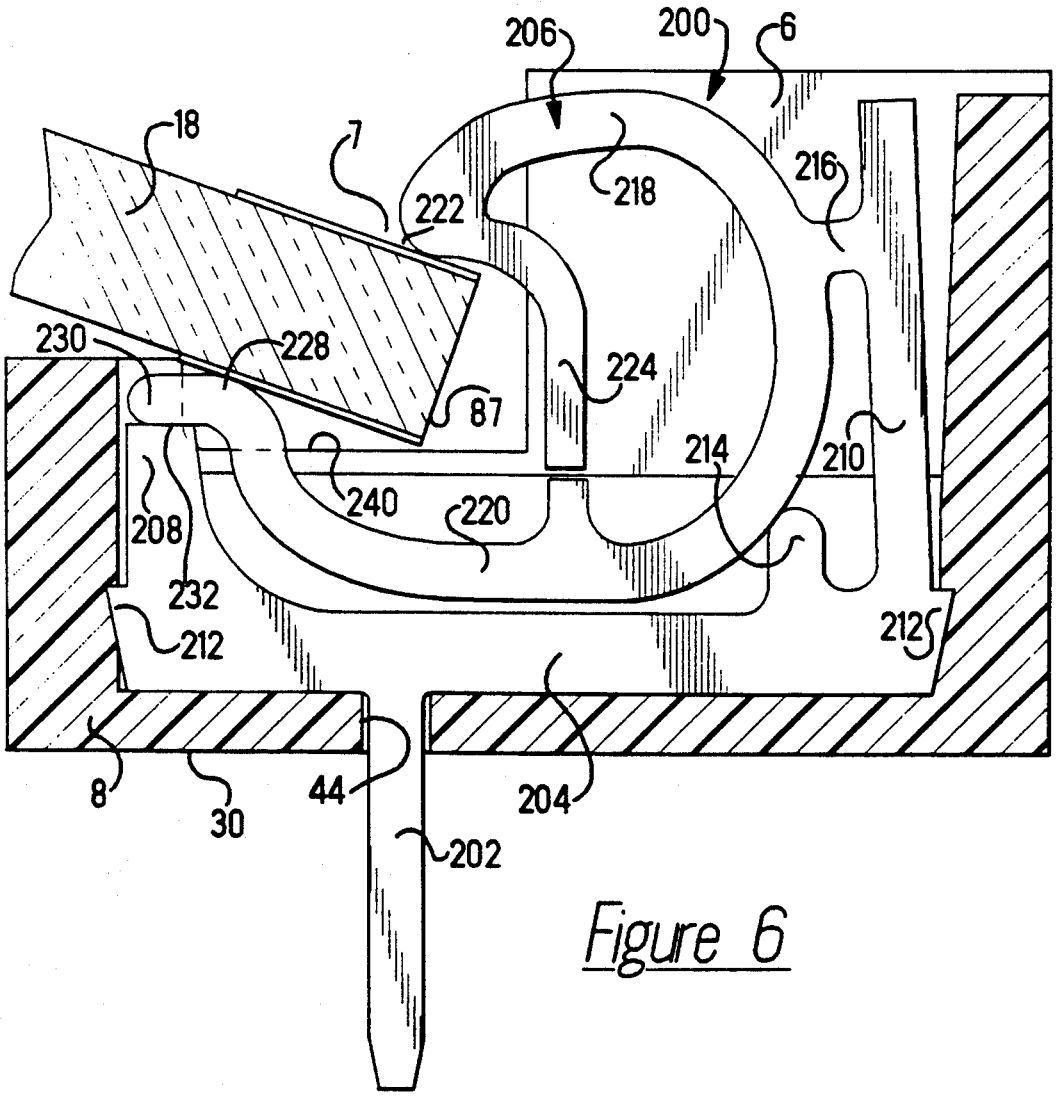
FIG. 6 is a cross-sectional view of the connector, similar to that of FIG. 4, showing the daughter board fully inserted into the connector.

A plurality of contact receiving cavities 6, as shown in FIG. 1 are provided in base 8. The cavities extend from the top surface 14 to proximate the bottom surface 30 of base 8, as is best shown in FIG. 2, 4, and 6. The cavities 6 extend in a direction which is essentially parallel to the ends 10 of the base, with each cavity being provided in communication with a board-receiving opening 7 in the base. The exact shape of the cavities varies according to the shape of the contacts to be inserted therein.

A respective contact 200 is disposed in each contact receiving cavity 6. Each contact 200 is made from sheet metal stock having the desired conductive and resilient characteristics. As shown in FIG. 2, the contact is comprised of a post 202, a base 204, and a resilient contact portion 206.

Contacts 200 are positioned in the cavities such that the posts 202 extend through an opening 44 in the bottom surface 30 of the base 8. The lower portions of the posts 202 are aligned with corresponding holes (not shown) of mother board 34 and inserted therein, thereby making electrical connections between the contacts 200 and the conductive areas on the mother board 34.

Proper positioning of the posts with respect to the holes of the mother board 34 is assured because pegs 26 properly align connector 2 with respect to the mother board. It should be noted that the lower portions of posts 202 may extend horizontally instead of vertically to allow the posts to be surface mounted to contact areas of the mother board.

The upper portions of the posts remain in the cavities 6 and are connected to base 204. The posts extend from various locations of the base of the contacts 200 in order to allow the posts to meet the desired centerline spacing requirements. This is merely a way of allowing the centerline spacing of the posts 202 to be as close as needed. The movement and operation of each contact 200 is not effected by the positioning of the posts.

The top of each post 202 is integral with some portion of the base 204. Bases 204 engage the walls of the cavities 6 to help secure and stabilize the contacts in the cavities.

As best shown in FIGS. 2, 4, and 6, each base has an overstress member 208 extending from a respective end thereof. A retention leg 210 of the contact portion 206 extends from the opposite end of the base. Overstress member 208 and retention leg 210 extend from the base 204 in essentially the opposite direction as post 202. Also provided at each end of the base 204 are barbs 212.

A contact projection 214 extends from the base in essentially the same direction as the retention leg 210. The contact projection 214 is positioned proximate to the retention leg 210, and as shown in the figures, is of significantly less height than the retention leg. The height and particular configuration of the contact projection 214 can be varied according to the characteristics required, as will be more fully explained.

The contact portion 206 has the retention leg 210 which extends from the base, a relatively weak neck 216 which extends perpendicularly from the retention leg, a first resilient contact leg 218 which extends from the neck, and a second resilient contact leg 220 which extends from the neck and is integrally attached to the first contact leg.

Figure 3:
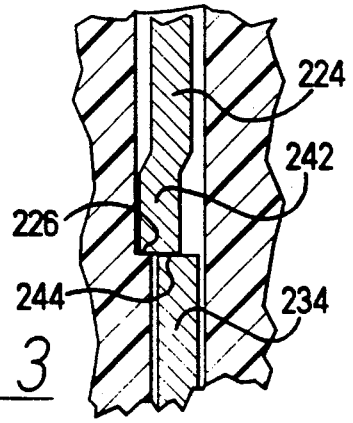
FIG. 3 is a partial view taken along line 3—3 of FIG. 2, showing an overstress member of the contact in an engaged position.
Figure 5:
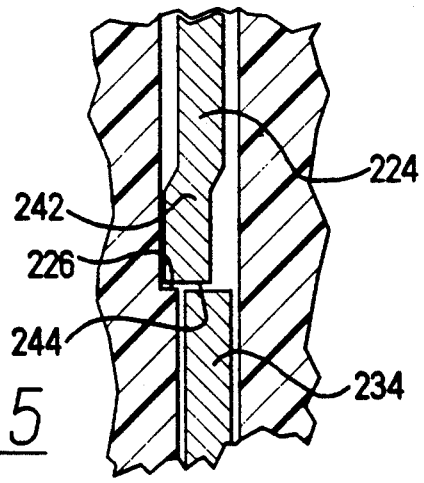
FIG. 5 is a partial view taken along line 5—5 of FIG. 4, showing the overstress member of the contact in an unengaged position.

In the embodiment shown in FIGS. 2, 4, and 6, the first resilient contact leg 218 has an arcuate first contact surface 222 and an offset first overstress member 224. As shown in FIG. 3 and 5, the first overstress member 224 is offset from the plane of the contact 200, thereby allowing the first overstress member 224 to cooperate with a shoulder 226 of the housing 4.

The second resilient contact leg 220 has a generally C-shaped configuration. An arcuate second contact surface 228 is positioned proximate the free end of leg 220. Also provided proximate the free end is member 230 which has a shoulder 232. A second overstress 234 extends from the second contact leg 220 in a direction away from base 204. The second overstress members 234 is positioned to cooperate with the fist overstress member 224, as will be more fully discussed.

Terminals or contacts 200 are positioned in the contact receiving cavities 6. Barbs 212 cooperate with the walls of the cavities 6 to maintain the contacts 200 therein. The barbs displace the material of the housing 4 in the typical manner, thereby preventing the removal of the contacts from the housing.

Daughter board 18 is inserted into the cavities 6 at an angle, as shown in FIGS. 2 and 4. This insertion occurs under zero or low insertion force conditions depending on the thickness of the daughter board 18. If the thickness on the daughter board is less than the distance between contact surfaces 222, 228, the insertion force will be zero. If the thickness of the daughter board is greater than the distance between contacts surfaces 222, 228, the insertion will occur under reduced insertion force conditions.

The insertion of the daughter board 18 into recess 7 is done at an angle as shown in FIG. 2. Daughter board 18 is inserted into the opening until a leading corner 87 of the daughter board engages a stop surface 240 of the housing 4, as shown in FIG. 4. For ease of explanation, the insertion of the daughter board will be explained with relationship to a single contact. It is important to not that all of the contacts operate in a similar fashion, and therefore, the explanation of the operation applies to all of the contacts of the connector.

It is conceivable that the daughter board 18 may be slightly misaligned as the board 18 is inserted into the recess 7. When this occurs, it is likely that the board 18 will engage a surface of the first resilient leg 218, as shown in FIG. 2. As the insertion of the board continues, the board will be pushed toward the base 204 of the contact, causing the board to force the first resilient leg 218 to be deformed toward base 204. If this deformation is not controlled, the first resilient leg 218 will be damaged, i.e. take a permanent set, rendering the contact 200 effectively useless, as a positive electrical connection will not be effected between the contact and the daughter board.

In order to control the deformation described above, the first overstress member 224, the second overstress member 234, and shoulder 226 of the housing cooperate to prevent the overstress of the first resilient leg 218. As shown in FIGS. 3 and 5, the first overstress member 224 has an offset portion 242. The offset portion 242 is displaced such that the longitudinal axis of the offset portion is laterally displaced from the longitudinal axis of the overstress member 224.

As the slightly misaligned daughter board is inserted into the recess 7, the leading corner 87 engages the first resilient leg 218, causing leg 218 to be displaced toward base 204. This in turn causes the offset portion 242 to be moved from the position shown in FIG. 5 to the position shown in FIG. 3. With the offset portion 242 positioned as shown in FIG. 3, further movement of the first overstress member 224 toward the second overstress member 234 is prohibited due to the cooperation of the end 244 of the offset portion 242 with the shoulder 226 of the housing 4. As the downward movement of overstress member 224 is prevented, so to is the downward movement of the first resilient leg 218. Consequently, the positive stop provided by the shoulder 226 prevents the first resilient leg 218 from taking a permanent set. This overstress feature thereby insures that the first resilient leg 218 will maintain its desired shape and resilient characteristics even when the daughter board 18 is improperly inserted into recess 7.

After the leading corner 87 is moved beyond the surface of the first resilient leg 218, and into the opening 7 between contact surfaces 222, 228, the leg 218 is resiliently returned to the position indicated in FIGS. 4 and 5. As shown in FIG. 5, the overstress members 224, 234 are again separated, and the first overstress member 224 is moved away from shoulder 226.

Once the daughter board 18 is inserted between contact surfaces 222 and 228, as shown in FIG. 4, the daughter board is rotated to the position indicated in FIG. 6. As the board 18 is rotated, first and second contact surfaces 222, 228 are forced toward the walls of the cavities 6. The resilient nature of the first and second resilient contact legs 218, 220 insures that the resilient legs will oppose the rotation causing a force to be generated against the daughter board. This force is of sufficient magnitude to maintain the contact surfaces in engagement with the board as the board is rotated. The continued rotation of the board causes the resilient forces supplied by the legs to increase, thereby insuring that a positive electrical connection will be effected between the contacts 200 and the board 18.

As the position shown in FIG. 6 is reached, the printed circuit board 18 engages latch projections 16 (FIG. 1), thereby securing the board in the fully inserted position.

In the fully inserted position, as shown in FIG. 6, shoulder 232 of the second resilient contact leg 220 engages the top surface of the overstress member 208. This insures that the second resilient legs 220 will not be overstressed as the board in rotated to the fully inserted position.

When the board is in the fully inserted position, the shoulders 232 and overstress member 208 may remain in engagement. The engagement of the shoulder with the overstress member provides a relatively short electrical pathway over which the electrical signals can travel from the daughter board to the mother board. This becomes particularly important in high speed applications.

It is important to note, that although shoulder 232 is shown in engagement with overstress member 208, there are instances in which this will not occur. For instance, many printed circuit boards are warped, causing the daughter board to be bowed in the middle. This bowing causes various contacts 200 to have their shoulders 232 displaced from the overstress members 208. Consequently, as the shoulders 232 and overstress members 208 are not in electrical engagement, the electrical signals must travel a different path than previously described.

In order to minimize the path length when the shoulder and overstress member are not in engagement, the second resilient leg 220 is placed in electrical engagement with the contact projection 214 when the daughter board is fully inserted. This allows the signals to travel through the second resilient leg 220 to the contact projection 214 to the base 204. The arcuate configuration of the free end of the contact projection 214 cooperates with the arcuate edge surface of the second resilient leg 220, as shown in FIG. 6, to position the leg in engagement with the projection. This engagement is ensured by the resiliency of the leg 220, even if the board is warped. Consequently, a positive electrical connection is insured for every contact between either the second resilient leg and the overstress member or the second resilient leg and the contact projection.

To remove the daughter board 18 from the connector 2, latch members 12 must be pushed toward ends 10 of base 8 to disengage latching projections from the board, allowing the board to be rotated in the opposite direction of that previously described. Board 18 is returned to the same angle in which it was inserted and removed under the identical zero or reduced force conditions under which it was inserted. Once the board is removed, the contacts 200 resiliently return to their original position, placing connector 2 in the proper position to repeat the process described above.

Figure 7:
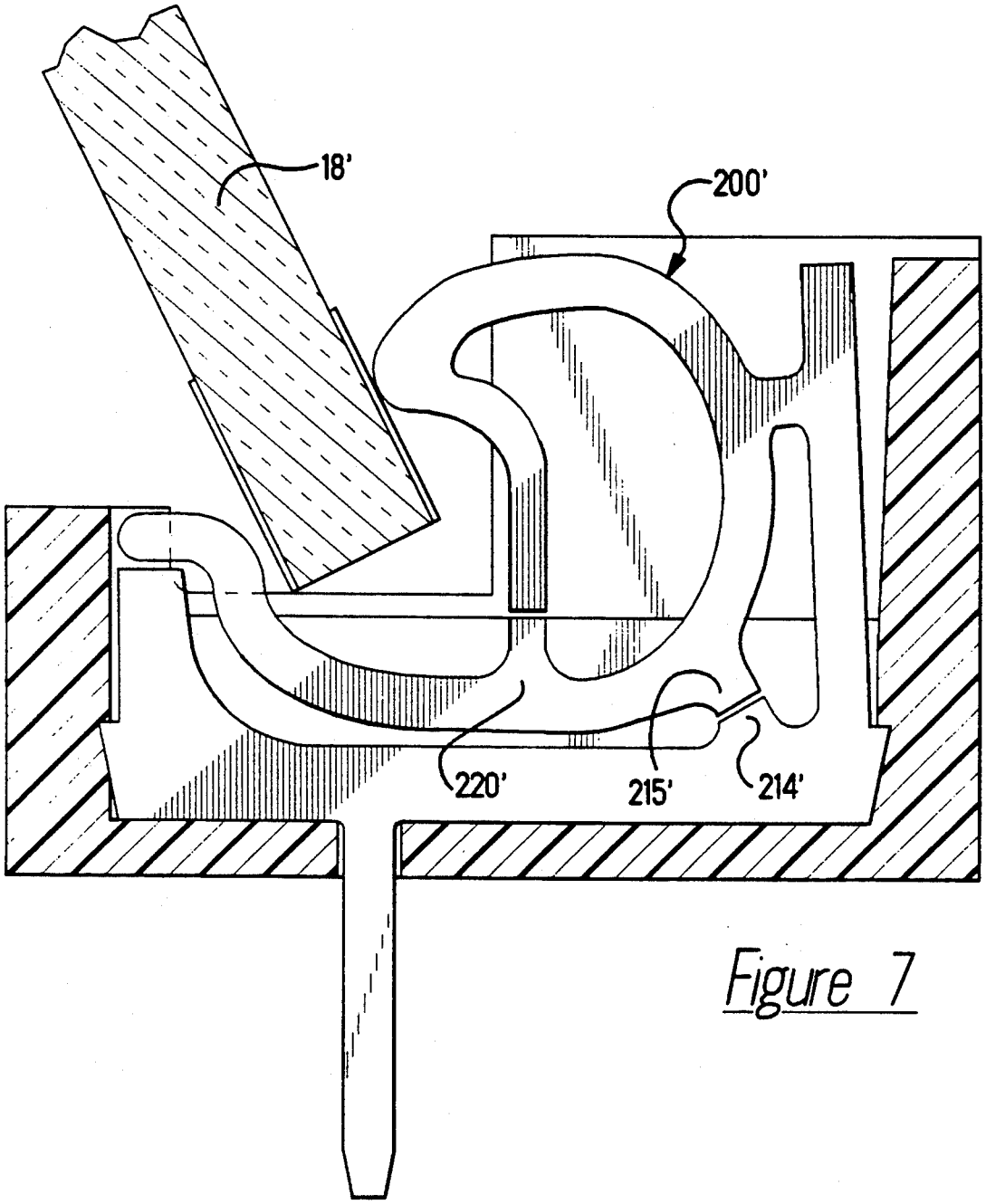
FIG. 7 is a cross-sectional view of an alternate embodiment of the contact showing a daughter board partially inserted into the connector.
Figure 8:
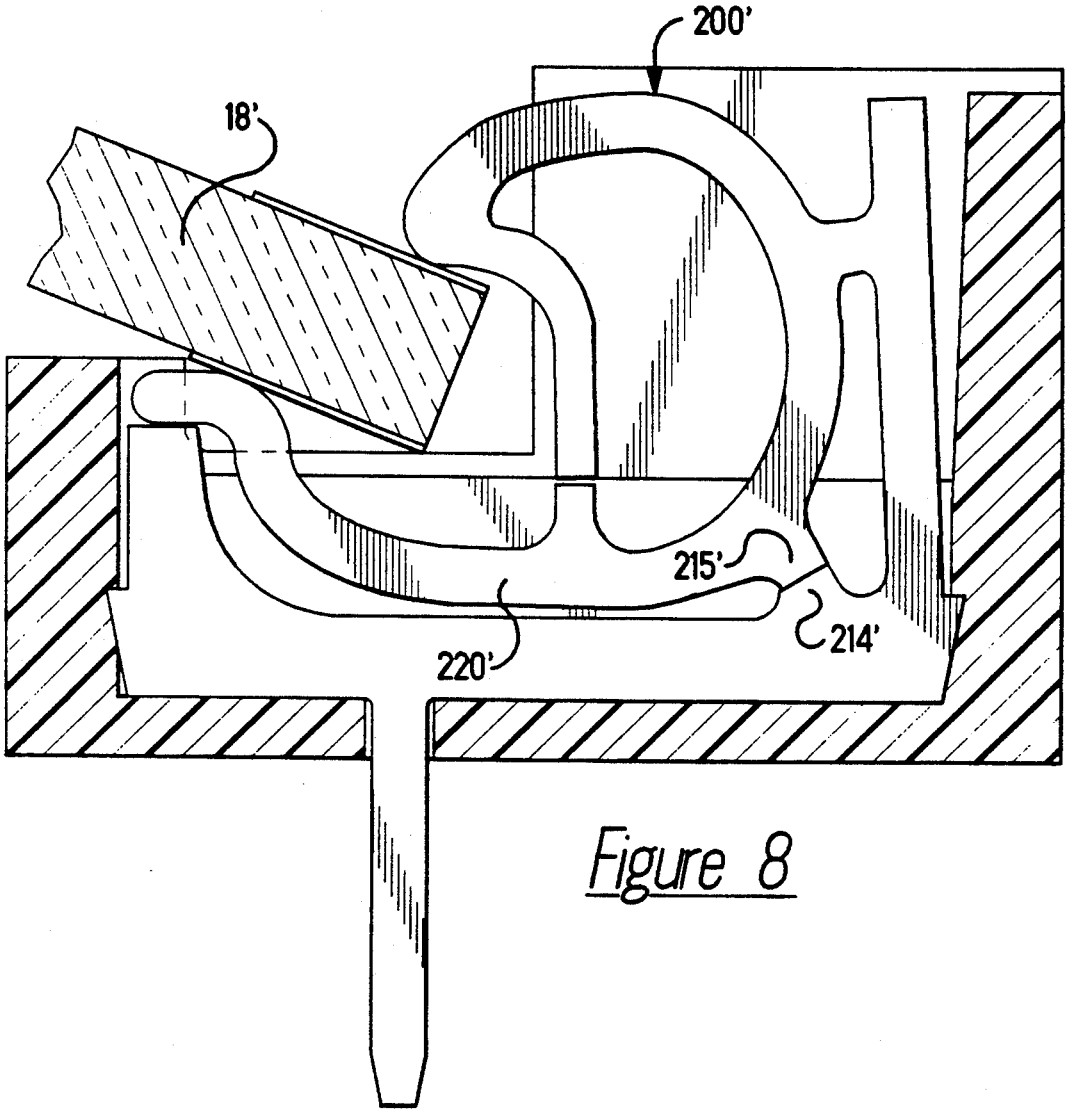
FIG. 8 is a cross-sectional view similar to that shown in FIG. 7, showing the daughter board fully inserted into the connector.

FIGS. 7 and 8 show an alternate embodiment of the invention. The contact operates in the identical fashion described above. This embodiment differs from that shown in FIGS. 1 through 6 in that the particular shape of the contact 200' and the shape of the contact projection 214' are slightly varied. In this embodiment, a mating contact projection 215' extends from the second resilient leg 220', as shown in FIGS. 7 and 8. The mating contact projection 215' engages the contact projection 214' when the board 18' is fully inserted. As best shown in FIG. 8, the ends of the projections 214', 215' are configured to provide a large area of engagement over which the signal may travel.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical connector for connecting a first printed circuit board to a second printed circuit board, the second printed circuit board being rotatable relative to the first printed circuit board between a first and a second position, the electrical connector having a housing with a recess provided therein, the recess extends from proximate a first end of the housing to proximate a second end of the housing, and is dimensioned to receive the second printed circuit board therein, contact terminals are positioned adjacent to the recess, and are configured to make an electrical connection with the second printed circuit board when the second printed circuit board is in the second position in the recess, the electrical connector comprising:

the contact terminals have base portions for securing the contact terminals in the housing, post portions for making electrical connection with the first printed circuit board, and resilient contact portions for making electrical connection with the second printed circuit board, the resilient contact portions have overstress projections integral therewith, the longitudinal axis of each overstress projection is offset from the longitudinal axis of the respective resilient contact portion from which it extends;

shoulders provided in contact receiving cavities of the housing, the shoulders are provided proximate the overstress projections of the resilient contact portions;

whereby as the second printed circuit board is moved relative to the contact terminals, the overstress projections engage respective shoulders of the housing to prevent the resilient contact portions from being deformed.

2. An electrical connector as recited in claim 1 wherein the overstress projections provided on the resilient contact portions are integral with the resilient contact portions, the overstress projections are bent relative to the resilient contact portions, such that the longitudinal axis of the overstress projections are positioned in a different plane than the longitudinal axis of the resilient contact portions.

3. An electrical connector as recited in claim 2 wherein the resilient contact portions have two resilient contact members, first resilient contact members extend from neck portions and have first contact surfaces provided at curved portions thereof, second resilient contact members extend from the neck portions and have second cotnact surfaces provided proximate the ends thereof, the first and second resilient contact members are movable between first positions and second positions.

4. An electrical connector as recited in claim 3 wherein the overstress projections are integral with and provided at free ends of the first resilient contact members.

5. An electrical connector as recited in claim 1 wherein second overstress projections extend from the bases of the contact terminals, the second overstress members cooperate with the edge surfaces of the second resilient contact members to restrict the movement of the second resilient contact members, whereby the second resilient contact members ares prevented from taking a permanent set.

6. An electrical connector as recited in claim 5 wherein the second resilient contact members cooperate with contact projections which extend from the bases, edges of the second resilient contact members electrically engage the contact projections when the second resilient members are moved to the second position.

7. A connector having at least one electrical contact provided therein the connector comprising:

the contact has a base with at least one contact leg extending from the base, an overstress projection is provided on the at least one contact leg, the overstress projection is bent relative to the at least one contact leg, such that the longitudinal axis of the overstress projection is positioned in a plane which is offset from the plane of the longitudinal axis of the at least one contact leg;

at least one shoulder positioned in the connector, the at least one shoulder provided proximate the overstress projection, whereby as the at least one contact leg is moved between a first position and a second position, the overstress projection, whereby as the at least one contact leg is moved between a first position and a second position, the overstress projection engages the at least one shoulder to prevent the deformation of the at least one contact leg.

8. An electrical connector as recited in claim 7 wherein the overstress projection of the contact is provided at the end of the at least one contact leg.

9. An electrical connector as recited in claim 8 wherein a first portion of an end of the overstress projection engages the at least on shoulder, and a second portion of the end of the overstress projection engages a second projection, whereby the engagement of the overstress projection with the second projection provides an electrical path over which the signals can be transmitted.

10. An electrical connector as recited in claim 7 wherein a contact projection extends from the base whereby as the at least one contact leg is moved to the second position, the at least one contact leg will engage the contact projection to provide an electrical connection therebetween.

11. An electrical connector as recited in claim 10 wherein the contact projection is positioned between the at least one contact leg and a second contact leg.

* * * * *